US005564304A

United States Patent [19]

Schlabach

[11] Patent Number: 5,564,304

[45] Date of Patent: Oct. 15, 1996

[54] TOOL FOR ROUNDING THE END OF A TUBE

[76] Inventor: David Schlabach, 3331 County Rd. 160, Millersburg, Ohio 44654

[21] Appl. No.: 402,942

[22] Filed: Mar. 13, 1995

[51] Int. Cl.[6] ..... B21D 19/00; B21D 41/00

[52] U.S. Cl. ..... 72/479; 72/457; 173/90

[58] Field of Search ..... 72/457, 479; 173/90

[56] References Cited

U.S. PATENT DOCUMENTS 2,934,984 5/1960 Woodman ..... 72/457
3,417,603 12/1968 Loew ..... 72/479
3,570,289 3/1971 Smyers ..... 72/479
3,837,213 9/1974 Guzzo ..... 72/479
4,624,323 11/1986 Burrola ..... 72/457

*Primary Examiner*—David Jones
*Attorney, Agent, or Firm*—Patnaude, Videbeck & Marsh

[57] ABSTRACT

A tool for rounding the end of a tube has an anvil with a cylindrical midsection and a tapered forward end. Extending rearwardly from the rear end of the anvil is an elongate shaft, and around the elongate shaft is a cylindrical hammer which slides axially along the shaft to strike the rear surface of the anvil. The hammer is retained in the shaft by any appropriate means such as a threaded nut or external flange at the distal end thereof.

6 Claims, 1 Drawing Sheet

TOOL FOR ROUNDING THE END OF A TUBE

The present application relates to a tool for working a piece of copper tubing prior to soldiering and, in particular, to rounding the end of a piece of copper tubing.

BACKGROUND OF THE INVENTION

Copper tubing is used to convey liquids and gasses for a multitude of purposes and is available in a wide range of diameters. The construction industry, for example, makes use of tubing having outer diameters of ¾ inch, 1 inch, 1½ inch, 2 inch, and other sizes. Since copper has a high degree of flexibility, it has become customary to market long lengths of copper tubing on spools. A technician who wishes to install a piece of copper tubing must first select the spool having tubing of the desired diameter, and then unwind and cut the desired length. The installation process is completed when each of the ends of the tubing are attached to fittings by an appropriate means such as soldering. To attach the fitting, the outer diameter of the tubing may be fitted into a cylindrical bore in the fitting and thereafter the parts are soldered together, or the fitting may provide a tubular nipple around which the inner diameter of the tubing is fitted and, again, soldered.

Although it is common to market and store copper tubing on spools, the wrapping of copper tubing around such spools causes the cross-sectional shape of the tubing to become oval, rather than round. When a length of copper tubing is unwound from the spool and cut to the desired length, the ends of the tubing must be rounded before they can be attached to a fitting having either a cylindrical bore for receiving the outer diameter of the tubing, or a tubular nipple for fitting within the inner diameter of the tubing.

Prior to the present invention, it has been general practice to use a hammer or other tools to manually round the distal end of a length of tubing prior to attachment of a fitting. Such manual operations, however, are time consuming and generally do not result in a true rounding of the end. As a result, the soldering of the end of a length of tubing can be unduly time consuming. It would be desirable to provide a tool which would facilitate the rounding of the end of a length of copper tubing so that it may be attached to a fitting without requiring the technician to manually round the end.

SUMMARY OF THE INVENTION

Briefly, the present invention is embodied in a tool for rounding the end of a tube. The tool includes an anvil made of a metal which is harder than copper, or any other metal from which tubing may be manufactured. The anvil has a rear end, a cylindrical midsection, and a solid tapered forward end. Extending rearward from the rear end of the anvil is an elongate shaft. Fitted around the elongate shaft is a cylindrical hammer which can be moved axially along the shaft so as to strike the rear surface of the anvil. The hammer is retained on the shaft by any appropriate means such as a nut threaded up on the distal end thereof, or by an external flange on the distal end thereof.

In the preferred embodiment, a retainer is provided to secure the rear end of the anvil to the shaft. The retainer has a bore in the forward end having a plurality of stepped diameters adapted to receive a plurality of anvils, each having an outer diameter equal to the inner diameter of one of the steps of the bore. The rear end of the retainer is adapted to be secure to the shaft by any appropriate means, such as a threaded bore in the retainer, into which the forward end of the shaft, having complementary threads thereon, is fitted.

In accordance with the present invention, the cylindrical midsection of each anvil is equal to the inner diameter of the size of tubing to be rounded by the tool. To round the distal end of a length of tubing, the tapered forward end of the tool is inserted into the end of the tubing. Thereafter, the hammer is slid axially along the length of the shaft so as to strike against the rear end of the retainer. Accordingly, the anvil, fitted at the forward end of the retainer is driven into the inner opening of the tubing. The operator will continue to strike the hammer against the retainer until a length of the cylindrical midsection of the anvil has been driven into the inner opening of the tubing, thereby causing the tubing to be rounded at its distal end. Generally, one inch or more of each end of a length of tubing must be rounded before it can be attached to a fitting, and, therefore, at least one inch of the cylindrical midsection of the anvil must be driven into the tubing.

Once the distal end of the tubing has been rounded, the tool can be removed from the end of the tubing by striking the hammer against the nut, or retaining flange at the rear end of the shaft, thereby forcing the anvil out of the inner opening of the tubing.

GENERAL DESCRIPTION OF THE DRAWING

Further objects and advantages and a better understanding of the present invention will be had by a reference to the following detailed description taken in conjunction with the accompanying drawings wherein FIG. 1 is a cross-sectional view of a tool in accordance with the present invention fitted into the distal end of a length of tubing; and FIG. 2 is a cross-sectional view of a second embodiment of a tool in accordance with the present invention.

DETAILED DESCRIPTION OF THE PREFERRED EMBODIMENT

Figure 1:
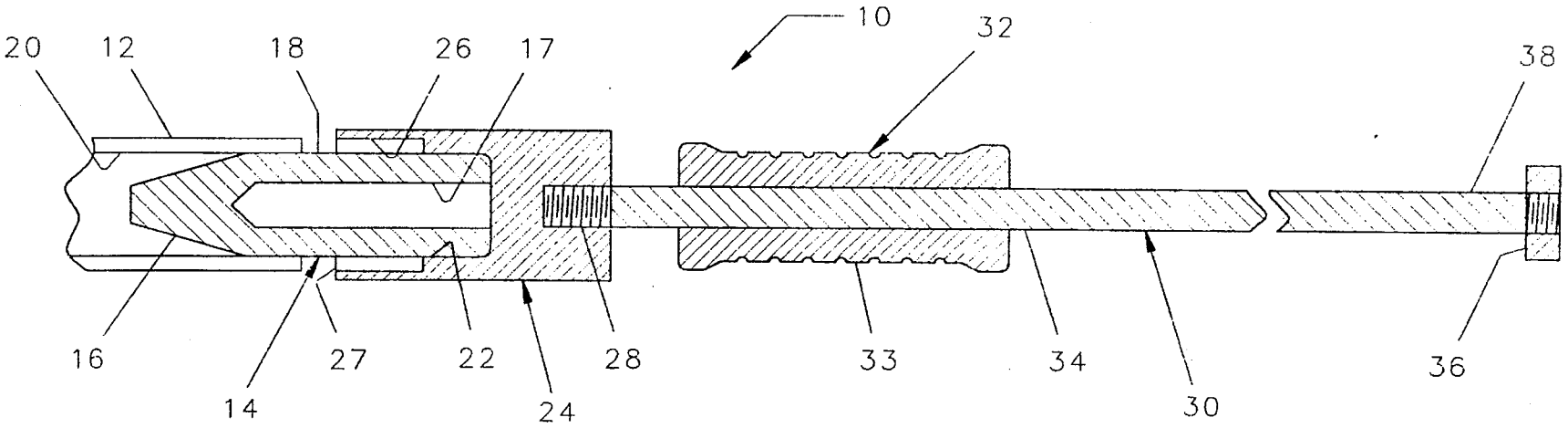

Referring to FIG. 1, a tool 10 can be used to round the distal end of a length of tubing 12. The tool 10 has at the forward end thereof an anvil 14, which is typically made of metal that is harder than the hardness of the metal used in the tubing 12 the end of which is to be rounded. The anvil 14 has a tapered forward end 16, which in FIG. 1 is depicted as having a frustoconical outer surface. In this embodiment, the anvil 14 has a bore 17 extending axially therein from the rearward end thereof. Behind the tapered forward end 16, the anvil 14 has a cylindrical body 18, the outer diameter of which is equal to the inner diameter 20 of the tube 12.

The rearward end of the cylindrical body 18 of the anvil 14 is fitted into a cylindrical bore 22 in the forward end of a retainer 24. As depicted in FIG. 1, the retainer 24 has a first cylindrical bore 26 suitable for receiving an anvil, not shown, having an outer diameter equal to the inner diameter of the cylindrical bore 26, and a second cylindrical bore 22 adapted to receive the anvil 14 having an outer diameter equal to the diameter of the second bore 22. The retainer 24 may, therefore, be used to retain the anvil 14 or a larger anvil, not shown, having an outer diameter equal to the second inner diameter 26. As further explained below, the forward end of the cylindrical body 18 must be forced into the inner opening 20 of a piece of tubing 12 in order to round the end thereof, and therefore, the cylindrical body 18 should extend forward of the forward end 27 of the retainer a distance of at least equal to the diameter of the body 18. A threaded bore 28 in the rearward end of the retainer 24 is coaxial with the first and second bores 26, 22, respectively, and threaded into the threaded bore 28 is a threaded forward end of an elongate shaft 30.

A generally cylindrical metal hammer 32 has an inner bore 34 with a diameter a little larger than the outer diameter of the shaft 30 such that the hammer 32 is slidable along a length of the shaft 30. The outer surface of the hammer 32 may have etchings 33 on the surface thereof to facilitate the operator's grip on the hammer.

The hammer 32 is retained on the shaft 30 by a threaded nut 36 which is threaded onto complementary threadings on the rearward end of the shaft 30.

It should be appreciated that the shaft 30 must be sufficiently long to permit the installer to rapidly move the hammer 32 along the length thereof and strike the rearward surface of the retainer 24 and thereby drive the forward end of the anvil 14 into the inner opening of the tube 12. Where the outer diameter of the cylindrical body 18 of the anvil 14 is equal to the inner diameter 20 of the tube 12, forcing the cylindrical body 18 of the anvil 14 into the inner opening of the tube 12 will cause the distal end of the tube 12 to become rounded and conform to the cylindrical shape of the body 18. It is desirable to round a portion of the tubing which is approximately as long as the inner diameter of the tubing to be rounded to insure that the rounded end can be attached to a fitting. After a desired length of the cylindrical body 18 has been driven into the inner opening of the tubing 12, the tool can be removed by sliding the hammer 32 along the length of the tube 30 and striking it against the forward surface of the nut 36. As a result of the impact of the hammer 32 against the forward surface of the nut 36, the anvil 14 will be drawn outward of the distal end of the tube 12, and the tube 12 will thereafter be rounded and suitable for soldering to a fitting, not shown.

In accordance with the present invention, the anvil 14 can be removed from the forward end of the retainer 24 and a second anvil, not shown, having a body with an outer diameter equal to the first bore 26 inserted. Thereafter, the tool may be used to round the end of a piece of tubing having an inner diameter equal to the inner diameter of the first bore 26.

Figure 2:
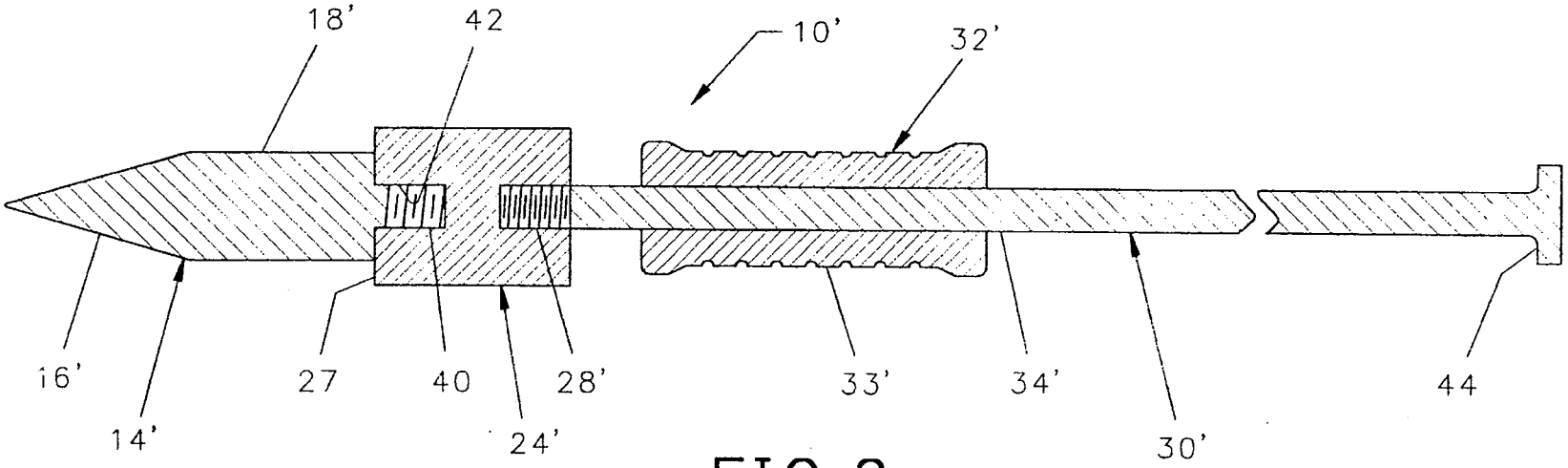

Referring to FIG. 2 in which elements which are like elements depicted in FIG. 1 bear like indicia numbers except that they are primed. In this embodiment, the forward end 16' of the anvil 14' is conical instead of frustoconical. It should be appreciated that the tapered forward end 16' may have any of a number of configurations which would facilitate the insertion of the forward end 16' of the anvil 14' into the end of a length of tube.

In accordance with this embodiment, a threaded stud 40 extends axially from the rearward end of the anvil 14', and the stud 40 is threaded into a complementarily threaded bore 42 on the forward end of the retainer 24'. Also, the hammer 32' is retained on the shaft 30' by an outer flange 44 at the distal end of the shaft 30.

There has, therefore, been described a tool which can be used to round the end of a length of tubing.

While two embodiments of the present invention have been disclosed, it will be apparent to those skilled in the art that many changes and modifications may be made without departing from the true spirit and scope of the invention. It is the purpose of the appended claims to cover all such changes and modifications which fall within the true spirit and scope of the invention.

What is claimed:

1. A tool for rounding the end of a tube comprising in combination:

an anvil having a rear end, a cylindrical body sized for insertion into an end of tube and a tapered forward end contiguous with said cylindrical body, said tapered forward end having a maximum diameter equal to a diameter of said cylindrical body, a retainer having a forward end and a rearward end, said forward end having means for detachably attaching an anvil thereto, a shaft extending from said rearward end of said retainer, said rear end of said anvil detachably attached to said forward end of said retainer in axial alignment with said shaft, a hammer slidable along said shaft, and means for retaining said hammer on said shaft.

2. The tool in accordance with claim 1 wherein said rear end of said anvil is a threaded cylindrical and said forward end of said retainer has a threaded bore complementary to said threads of said anvil.

3. The tool in accordance with claim 1 wherein said means for retaining said hammer on said shaft includes threadings on a rearward end of said shaft, and a nut on said threadings.

4. The tool in accordance with claim 1 wherein said rear end of said anvil is cylindrical and is fitted into a cylindrical bore in said forward end of said retainer.

5. The tool in accordance with claim 1 wherein said means for retaining said hammer on said shaft includes an exterior flange on the rearward end of said shaft.

6. A tool for rounding the end of a tube comprising in combination:

an anvil having a rear end, a cylindrical body sized for insertion into an end of a tube and a tapered forward end contiguous with said cylindrical body, said cylindrical body having a length and a diameter, said length being at least equal to said diameter, said tapered forward end having a maximum diameter equal to said diameter of said cylindrical body, a retainer having a forward end and a rearward end, said forward end for detachably retaining an anvil, a shaft extending from said rearward end of said retainer, said rear end of said anvil detachably attached to said forward end of said retainer in axial alignment with said shaft, a hammer slidable along said shaft, and means for retaining said hammer on said shaft.

* * * * *

UNITED STATES PATENT AND TRADEMARK OFFICE

CERTIFICATE OF CORRECTION

PATENT NO. : 5,564,304

DATED : October 15, 1996

INVENTOR(S) : David Schlabach

It is certified that error appears in the above-identified patent and that said Letters Patent is hereby corrected as shown below:

In column 4, line 12, after "of" insert --a--.

Signed and Sealed this

Fourteenth Day of January, 1997

*Attest:*

Bruce Lehman

BRUCE LEHMAN

*Attesting Officer*

*Commissioner of Patents and Trademarks*